United States Patent [19]

Irmer

[11] Patent Number: 4,624,675

[45] Date of Patent: Nov. 25, 1986

[54] WOVEN COTTON FABRIC AND ITS PREPARATION

[75] Inventor: Siegfried Irmer, Reutlingen, Fed. Rep. of Germany

[73] Assignee: Möve-Werk GmbH & Co. KG, Reutlingen, Fed. Rep. of Germany

[21] Appl. No.: 762,059

[22] Filed: Aug. 2, 1985

[30] Foreign Application Priority Data

Mar. 8, 1985 [DE] Fed. Rep. of Germany ..... 3508386
Mar. 25, 1985 [DE] Fed. Rep. of Germany ..... 3510730

[51] Int. Cl.[4] ..... D06L 3/02

[52] U.S. Cl. ..... 8/115.6; 8/137; 8/138; 428/85; 428/224

[58] Field of Search ..... 8/137, 138, 115.6

[56] References Cited

U.S. PATENT DOCUMENTS 4,099,913 7/1978 Walter et al. ..... 8/115.6
4,500,318 2/1985 Sands et al. ..... 8/138

*Primary Examiner*—James J. Bell
*Attorney, Agent, or Firm*—Berman, Aisenberg & Platt

[57] ABSTRACT

A process for producing a woven cotton fabric wherein the warp is treated with water-soluble cold size. A pile warp, if present, is sized after warping. After weaving, the size is washed out with soda and a decalcifying agent. By rinsing twice, the dissolved size, lime and soda residues are removed. Drying is effected on a tenter frame, with or without shrinking. The process produces a fabric wherein the cotton fibers retain many of their natural properties.

21 Claims, No Drawings

WOVEN COTTON FABRIC AND ITS PREPARATION

TECHNICAL FIELD

The present invention relates to cotton fabric and a process for producing cotton fabric, e.g., a terry cloth fabric, having a main warp, a weft and, optionally, a pile warp. The process does not employ chemicals which leave behind potentially irritating residues; it provides a fabric which is naturally strong and absorbent.

BACKGROUND OF THE INVENTION

Many known methods are capable of improving the loom or raw state of cotton fabrics. In the field of textile improvements, mechanical and chemical finishing methods are employed. Mechanical finishing processes include desizing (i.e., preserving the warp threads), singeing, fulling, roughening, friezing, calendaring, sanforizing and hot pressing. Chemical finishing processes include, among others, scouring, bleaching, chlorinating and mercerizing. These treatment processes modify natural fibers in many ways and are capable of providing textiles having properties desired by the fashion industry. Unfortunately, many treatments leave behind chemical residues which irritate susceptible persons.

SUMMARY OF THE INVENTION

The present invention provides a process for producing a natural cotton fabric which has many desired properties. Most importantly, the cotton fibers retain many of their natural characteristics. Cotton fibers contain an interior hollow space, and this space is not diminished by the present process. Consequently, fabric woven from cotton treated by the present process provides excellent thermal insulation. The cotton fibers retain their corkscrew twist which, in known processes, is removed and smoothed by bleaching or dying. Because the fibers retain this twist, they remain more elastic, and the interlinking between individual fibers is substantially stronger than among fibers treated by prior methods. Fabric prepared by the present process exhibits good tear resistance. The cotton fibers retain their natural wax-like coating and are thus static resistant without any special treatment.

According to the present invention, a woven cotton fabric having the noted desired properties is produced by wetting the main warp (at warping) with water-soluble cold size, washing out the size (after weaving) with soda and a decalcifying agent, washing the resulting fabric with warm clean water, rinsing and then drying the fabric on a tenter frame. Optionally, the fabric is shrunk on the tenter.

An object of the present invention is to provide a process for producing a cotton fabric which retains the inherent physical properties of natural cotton fibers and is still easily processed.

Another object of the present invention is to produce a natural cotton fabric without the use of harsh chemical treating or finishing agents.

A further object of the invention is to produce a natural cotton fabric which retains the waxes, fats and pectins naturally present in cotton fibers.

A still further object of the invention is to provide a non-irritating cotton fabric.

DETAILS OF THE INVENTION

These and other objects are achieved by the present process for producing a natural cotton fabric. The present process is useful for preparing woven fabrics of conventional warp and weft structure. This process is particularly useful for preparing a terry cloth fabric having a main warp, a pile warp and a weft.

At warping, the lengthwise yarns that form the warp structure are wetted with a water-soluble cold size. A fabric is then woven with conventional machinery and techniques. A plain, twill, satin or terry cloth weave, or any other desired weave, is prepared according to established conventional procedures.

The woven fabric optionally includes a pile warp to produce, e.g., a terry cloth. According to the inventive process, the pile warp is sized (after warping) with a water-soluble starch size. Carboxymethylcellulose is the water-soluble starch size of choice.

After weaving, the fabric is washed and rinsed to remove the size. In a first washing step, the size is washed from the fabric with soda and a decalcifying agent, such as Calgon®. The fabric again is washed, this time with warm clean water. This second washing step is preferably effected for about fifteen minutes at a temperature of about 90° C. This simple washing procedure allows naturally-present substances to remain in the cotton fibers.

Following the washing procedure, the fabric must be rinshed. Rinsing is preferaby carried out in two operations. Because rinsing is carried out without softeners, no regreasing occurs.

Depending on the particular use intended for the fabric, drying is effected on a tenter frame with or without shrinking. Terrycloth fabric used in the production of, e.g., bathrobes is preferably shrunk about 5 percent during drying. For the production of terry underwear fabric, however, the shrinking process is omitted.

The finished fabric which is prepared according to the present invention contains cotton fibers in a substantially natural state. The fabric is produced without using an alkaline decoction scouring step, bleaches or similar finishing processes. Dying steps are also omitted. A small number of seed husk residues are found on the cotton fibers. The fabric contains no size residue, and a visual quality inspection reveals a uniform pattern and clean fabrication. The fabric exhibits a natural red clay color.

Using a standard washing agent (containing no optical brightener and fully equivalent to conventional commercially-available washing agents), thus-obtained fabric (tested for washability in accordance with the standard DIN 53920, Paragraph 4.1, boil wash method at 90° C.), allowed to shrink on a tenter frame, further shrinks 3.2 percent in length and 4.8 percent in width. Unshrunk fabric exhibits about 8.1 percent shrinkage in the warp direction and about 6.5 percent shrinkage in the weft direction. These shrinkage values are well within normal ranges for cotton fabrics. Following this initial wash, the fabric exhibits normal absorbency.

The invention and its advantages are readily understood from the foregoing description. Various changes can be made in the present process without departing from the spirit and scope of the invention or sacrificing its material advantages. The described fabrics, conditions and agents are merely illustrative of preferred embodiments of the present invention.

What is claimed is:

1. In a process for producing woven cotton fabric having a main warp and a weft, the improvement which comprises:

wetting the main warp with water-soluble cold size, at warping, before weaving;

washing out the size with soda and a decalcifying agent, after weaving;

washing the resulting fabric with warm clean water;

rinsing the thus-washed fabric; and drying the rinsed fabric on a tenter frame; whereby treated cotton warp fibers comprise an interior hollow space, a corkscrew twist, and a wax-like coating similar to untreated cotton fibers, and said fibers are substantially free from chemical residue.

2. A process according to claim 1 wherein the woven cotton fabric is terry cloth.

3. A process according to claim 1 wherein the woven cotton fabric has a pile warp.

4. A process according to claim 3 wherein the pile warp is sized with a water-soluble starch size after warping.

5. A process according to claim 4 wherein washing out the size is effected at a temperature of about 90° C.

6. A process according to claim 4 wherein washing with clean water is effected for about 15 minutes at a temperature of about 90° C.

7. A process according to claim 4 which comprises two rinsing operations.

8. A process according to claim 4 wherein the drying is effected with shrinking.

9. A process according to claim 8 wherein the shrinking is about 5 percent.

10. A process according to claim 4 wherein the water-soluble cold size is carboxymethylcellulose.

11. A process according to claim 1 wherein washing out the size is effected at a temperature of about 90° C.

12. A process according to claim 1 wherein washing with clean water is effected for about 15 minutes at a temperature of about 90° C.

13. A process according to claim 1 which comprises two rinsing operations.

14. A process according to claim 1 wherein the drying is effected with shrinking.

15. A process according to claim 14 wherein the shrinking is about 5 percent.

16. A process according to claim 1 wherein the water-soluble cold size is starch size.

17. A process according to claim 1 wherein the water-soluble cold size is carboxymethycellulose.

18. A process according to claim 11 wherein washing with clean water is effected for about 15 minutes at a temperature of about 90° C.

19. A process according to claim 18 which comprises two rinsing operations.

20. A process according to claim 19 wherein the drying is effected with about 5 percent shrinking.

21. A woven cotton fabric which does not irritate human skin and which has a main warp, a weft and, optionally, a pile warp, the fabric consisting essentially of cotton fibers which:

contain an interior hollow space which is substantially the same as that of natural cotton fibers and which imparts thermal insulation properties to the fabric;

contain a corkscrew twist which is substantially the same as that of natural cotton fibers and which imparts elasticity, strength and tear resistance to the fabric;

contain a wax-like coating which is substantially the same as that of natural cotton fibers and which imparts static resistance to the fabric;

contain waxes, fats and pectins substantially the same as those naturally present in cotton fibers;

are substantially free of chemical residue and, substantially are chemically unmodified.

* * * * *